US006042458A

United States Patent [19]

Lehnig et al.

[11] Patent Number: 6,042,458

[45] Date of Patent: Mar. 28, 2000

[54] TURN BASE FOR ENTRAINED PARTICLE FLOW

[75] Inventors: Tony R. Lehnig, West Chester; Frederick C. Young, Maineville; David R. Linger, Cincinnati, all of Ohio

[73] Assignee: Cold Jet, Inc., Loveland, Ohio

[21] Appl. No.: 09/106,633

[22] Filed: Jun. 29, 1998

Related U.S. Application Data

[63] Continuation of application No. 08/933,019, Sep. 18, 1997, abandoned, which is a continuation of application No. 08/656,373, May 31, 1996, abandoned.

[51] Int. Cl.[7] ..... B24C 5/04

[52] U.S. Cl. ..... 451/102; 457/39; 457/76; 457/91; 457/94

[58] Field of Search ..... 451/101–102, 451/39, 91, 94, 76; 239/589; 137/39, 37

[56] References Cited

PUBLICATIONS

Titan *Pressure Blast Cleaning Equipment* Catalog 96, p. 7 Drawing.

*Primary Examiner*—Robert A. Rose
*Assistant Examiner*—George Nguyen
*Attorney, Agent, or Firm*—Frost & Jacobs LLP

[57] ABSTRACT

An entrained particle flow turning device capable of turning entrained particle fluid flow about an abrupt turn without significant particle size and mass degradation provides significant improvement as part of a complete particle blast system. The turning base allows for preservation of independent particle mass during fluid transportation through a delivery hose ending with passage into a blast nozzle through an abrupt angular change in particle direction. The turning base allows access and confined areas for preferred ergonomic characteristics.

145 Claims, 5 Drawing Sheets

TURN BASE FOR ENTRAINED PARTICLE FLOW

This is a continuation of U.S. Ser. No. 08/933,019, filed Sep. 18, 1997, incorporated by reference, now abandoned, which was a continuation of U.S. Ser. No. 08/656,373, filed May 31, 1996, now abandoned.

TECHNICAL FIELD

This invention relates generally to a device for changing the direction of a fluid flow containing entrained particles, and is particularly directed to a device for turning such entrained particle flow about a turn without deleterious affects to the particles or to the device itself. The invention will be specifically disclosed in connection with a base for use interposed between a delivery hose and a blast nozzle for abruptly turning a cryogenic flow of entrained sublimable particles.

BACKGROUND OF THE INVENTION

Entrained particle fluid flow is well known and can be found in numerous systems in a wide variety of uses. One such example of entrained fluid flow is in the field of particle blasting. With particle blasting, entrained particles are introduced into a flow of a transport fluid, such as a gas, flow through a delivery hose and out a blast nozzle to be directed at a high speed against a workpiece or target in order to achieve a desired result, such as cleaning and surface coating removal. Conventional particle fluid blast media includes sand, plastic beads, walnut shells and even shot peening. Recent years have seen significant growth in the use of sublimable particles, such as carbon dioxide, as the blast media. The use of sublimable particles is accompanied by cryogenic temperatures which typically improve performance. As used herein, the reference to entrained particle flow includes any particles now used or used in the future as blast media.

In many applications, it is necessary to control the direction of the entrained particle fluid flow. Preferably, when space permits, such turning of entrained particle flow is accomplished through large gentle bends in the delivery hose. However, in many applications, space constraints require tight or abrupt turns, such as when the workpiece or target is in an area having restricted access. Examples of this include the cleaning of molds and removal of surface coatings in tight places.

The prior art is virtually devoid of the ability to turn entrained particle fluid flow abruptly and efficiently. Abrupt directional change of entrained particle flow has typically involved sharp radial turns of the delivery hose (or pipe) blast nozzle. Substantial particle-to-particle and particle-to-wall collisions occur when sharp radial turns are present. When turned by such conventional means, typical particle blast fluid media, such as sand or plastic beads, which is relatively durable, do not suffer any significant loss in size or mass from the particle-to-particle or particle-wall contacts. However, significant erosion of the passageway at the outside of the turn typically occurs, creating a high wear area. This requires frequent maintenance to replace the affected component. When the turn of entrained particle flow occurs in a unitarily constructed nozzle, the entire nozzle must be replaced.

In contrast, sublimable blast media, such as carbon dioxide particles, can suffer significant reduction in size and mass due to such particle-to-particle and particle-to-wall collisions present in prior art turns. Since particle blasting performance is directly related to the particle velocity, mass and surface area covered by the blast impact, the blasting performance typically drops dramatically with such reduction of the integrity of individual particles when using conventional abrupt turning designs for sublimable particles.

Thus, there is a need in the art for a device to turn entrained particle flow without significant degradation or deleterious effects to the entrained particles themselves or to the device.

There is a need in the art for a device which can turn an entrained particle fluid flow without significant degradation of the particle size and mass, without significant erosion of the turn component, and correspondingly without significant degradation of overall blasting performance. To achieve this, in accordance with the teachings of the present invention, there is a need to be able to turn an entrained particle fluid flow without significant particle-to-particle contact and particle-to-wall contact. Additionally, there is a need for a device and method for turning entrained particle flow through an abrupt turn.

SUMMARY OF THE INVENTION

It is an object of this invention to obviate the above-described problems and shortcomings of the prior art heretofore available.

It is another object of the present invention to provide an apparatus and method for inducing an angular change in direction of a fluid flow of entrained particles without deleterious effects on the particles or on the device.

It is yet another object of the present invention to provide an apparatus and method for turning a fluid flow of entrained particles without a significant reduction in particle integrity.

It is another object of the present invention to provide an apparatus and method for turning a fluid flow of entrained particles which preserve the size and mass of the individual particles.

It is still a further object of the present invention to provide an apparatus and method for turning a fluid flow of entrained particles without significant erosion of the interior of the device.

It is yet a further object of the present invention to provide an apparatus and method for turning a fluid flow of entrained particles about an abrupt turn without significant particle-to-particle or particle-to-wall contacts.

It is another object of the present invention to provide an apparatus and method for turning a fluid flow of entrained carbon dioxide particles without agglomeration.

It is yet another object of the present invention to provide an apparatus and method for lowering the kinetic energy of particles entrained in a fluid flow prior to an abrupt turn.

It is still a further object of the present invention to provide an apparatus and method for turning a fluid flow of entrained particles which minimizes the standoff height.

It is yet a further object of the present invention to provide an apparatus and method for turning a fluid flow of entrained particles to which different nozzles may be attached, being selected for the appropriate application or being replaced as required without necessitating replacement of the device.

It is yet another object of the present invention to provide an apparatus and method which avoids the creation of vortical flow in a turn of entrained particle fluid flow.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided an apparatus for changing the direction of a fluid flow containing entrained particles, having an inlet, an outlet, a first internal passageway extending in a downstream direction from the inlet, a second internal passageway extending in an upstream direction from the outlet, the second internal passageway being in fluid communication with the first internal passageway at a turn, the second internal passageway being disposed at an angle to the first internal passageway, means disposed adjacent the turn for preventing significant particle-to-particle impacts and particle to wall impacts as the entrained particle flow flows from the first internal passageway to the second internal passageway, whereby the direction of entrained particle flow is turned without significant destruction to the entrained particles and the apparatus.

In accordance with another aspect of the present invention, said means comprise means for slowing the speed of at least a portion of the flow of entrained particles adjacent the turn.

In accordance with a further aspect of the present invention, the means comprise a diffusion pocket disposed adjacent the turn.

In accordance with yet another aspect of the present invention, the diffusion pocket is disposed downstream from the turn and is generally aligned with said first internal passageway.

In accordance with yet a further aspect of the present invention, the diffusion pocket comprises an extension of the first internal flow passageway beyond the turn.

In accordance with still another aspect of the present invention, the second internal passageway communicates at an angle with the first internal passageway through an opening formed in at least one of an end wall and a side wall.

In accordance with a still further aspect of the present invention, the entrance to the second internal passageway is a bellmouth entrance.

In accordance with another aspect of the present invention,the entrance is elliptical.

In accordance with a further aspect of the present invention, the entrance includes an upstream portion and is configured to produce a non-symmetrical fluid velocity distribution normal to the fluid flow, wherein the magnitude of the velocity of streamlines of the fluid flow are greatest adjacent the upstream portion of the entrance whereby slower streamlines of said fluid flow are turned by being drawn into the second flow passageway through the entrance.

In accordance with yet another aspect of the present invention, the entrance is configured not to produce separated flow adjacent the entrance.

In accordance with yet a further aspect of the present invention, the first internal passageway is configured to decelerate then accelerate the fluid flow.

In accordance with still another aspect of the present invention, the first internal passageway includes an offset between the inlet and the turn.

In accordance with a further aspect of the present invention, the first internal passageway has a normal cross-sectional shape which is generally an obround shape, whereby the first internal passageway includes a pair of arcuate sidewalls separated by a pair of spaced apart, substantially flat sidewalls.

In accordance with another aspect of the present invention, there is provided an apparatus for changing the direction of a fluid flow containing entrained particles, having an inlet, an outlet, a first internal passageway, a second internal passageway communicating at an angle with the first internal passageway through an opening, the opening including a leading edge, and the first internal passageway, second internal passageway and opening being configured to produce, when fluid flow flows therethrough at predetermined operating conditions, a velocity profile of particles entrained in the fluid flow in which there is a high velocity adjacent the leading edge and a low velocity distal to the leading edge.

In accordance with another aspect of the present invention, there is provided an apparatus for changing the direction of a fluid flow containing entrained particles, having an inlet, an outlet, a first internal passageway, a second internal passageway communicating at an angle with the first internal passageway through an opening, the opening including a leading edge, and the first internal passageway being configured to produce, when the entrained particle flow flows therethrough at predetermined operating conditions, a thin boundary layer along a portion of the sidewall of the first internal passageway adjacent the opening.

In accordance with another aspect of the present invention, there is provided an apparatus for changing the direction of a fluid flow containing entrained particles, having an inlet, an outlet, a first internal passageway, a second internal passageway communicating at an angle with the first internal passageway through an opening formed in at least one of an end wall and a side wall of the first internal passageway.

In accordance with another aspect of the present invention, a method is provided for changing the direction of an entrained particle fluid flow, comprising the steps of directing the fluid flow through a first internal passageway, turning the fluid flow into a second internal passageway at a turn, the first internal passageway being in fluid communication with the second internal passageway, slowing the speed of a portion of the particles at the turn such that significant particle-to-particle contacts and particle-to-wall contacts are prevented, whereby the direction of flow of the entrained particle flow is turned in the turn without significant destruction to the entrained particles and the internal passageways.

In accordance with another aspect of the present invention, the speed of a portion of the particles is slowed to be within an abrupt turn band.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
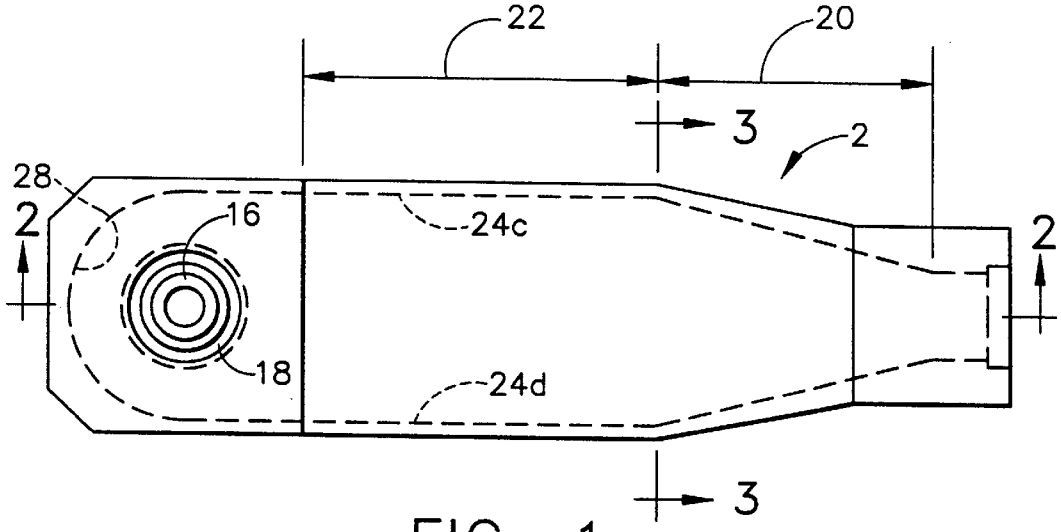
FIG. 1 is a bottom, plan view of an entrained particle flow turning device for changing the direction entrained particle fluid flow.

Reference will now be made in detail to the present preferred embodiment of the invention, an example of which is illustrated in the accompanying drawings.

DETAILED DESCRIPTION OF THE PREFERRED EMBODIMENT

While the present invention has particular application for abrupt flow turns, it will also be understood to be applicable to turns which are not abrupt. This invention and its teachings are useful to change the angular direction of any fluid flow with entrained particles, whether or not the particles are relatively durable and resistant to damage, such as reduction of mass or size resulting from particle-to-particle collisions or particle-to-wall collisions during the turn. As mentioned above, examples of such durable and damage resistant particles include sand and plastic beads. When such damage resistant particles are used, a primary concern is erosion of the internal passageway at the outside of a turn. In contrast, when the entrained particles are not resistant to reduction of mass or size resulting from particle-to-particle or particle-to-sidewall collisions, a primary concern is on damage to the particles themselves. Utilization of the teachings of the present invention avoids such deleterious wall erosion or particle damage.

For the purposes of explaining the present invention, cryogenic particle blast systems will be described. Such systems are well known in the industry, and along with the associated component parts, are shown in U.S. Pat. Nos. 4,947,592, 5,109,636 and 5,301,509, all of which are incorporated herein by reference. Such systems include a source of cryogenic particles, usually pellets which are typically made of carbon dioxide or any other suitable cryogenic material which preferably sublimes upon impact with the blasting target so that there is no residual particle material to be removed. Such particles are particularly susceptible to degradation due to impacts and direction changes in their flow path. Preservation of the mass of such carbon dioxide particles is important in order to maintain the performance of the system.

Considering particle mass degradation relative to particle kinetic energy upon surface impact, the kinetic energy level above which sublimable particles experience significant degradation through a turn, particularly through an abrupt turn, is a small percentage of the kinetic energy required above which durable blast media are significantly degraded through a turn. Due to the relatively low kinetic energy level required for $CO_2$ particle degradation or disintegration, $CO_2$ particle flows of a given average mass must be turned about corners at a relatively low velocity compared to other durable blast media in order for individual particles to maintain their mass through the turn. However, for $CO_2$ particles in particular, the velocity which allows for particle preservation during an abrupt flow turn is too low in magnitude to use throughout the entire $CO_2$ particle flow delivery system.

Attempts to use a mass preserving abrupt flow turn velocity for $CO_2$ particle flow throughout the entire delivery system have revealed a tendency for particle build up and flow path constriction around tight turns in delivery hoses or pipes, freezing of air moisture along the delivery hose or pipe with ice build up and flow path area reduction, and the related threat of premature hose or pipe failure. These tendencies are associated with the velocity being too low for steady state movement of $CO_2$ particles and the significant temperature drops related to the particle sublimation with related freezing of any water vapor in the transport fluid, such as compressed air. As the speed of the entrained particle fluid flow is reduced, $CO_2$ particles can become lodged through tight turns and minor delivery hose connection cavities. Additionally, because of the low particle energy, the particles do not effectively prohibit and wash away frozen water vapor build up as they would for reasonably higher velocities. As obstruction of the system particle fluid path develops, the tendency for further path degradation downstream increases, and the safety threat of unregulated pressure rising beyond the delivery hose or pipe design pressure because of undesirable flow path blockage increases. Moreover, the localized extreme hose temperatures related to such $CO_2$ particle flow blockage can also contribute to premature delivery hose or pipe failure by locally exceeding material system design limits.

Thus, in accordance with an aspect of the present invention, in order to provide an efficient, effective turning of entrained $CO_2$ particle fluid flow, it is necessary to keep the kinetic energy level below a maximum kinetic energy level above which significant particle destruction occurs and above a minimum kinetic energy level below which unsteady particle fluid flow occurs. This range is referenced herein as the abrupt turn band.

Figure 2:
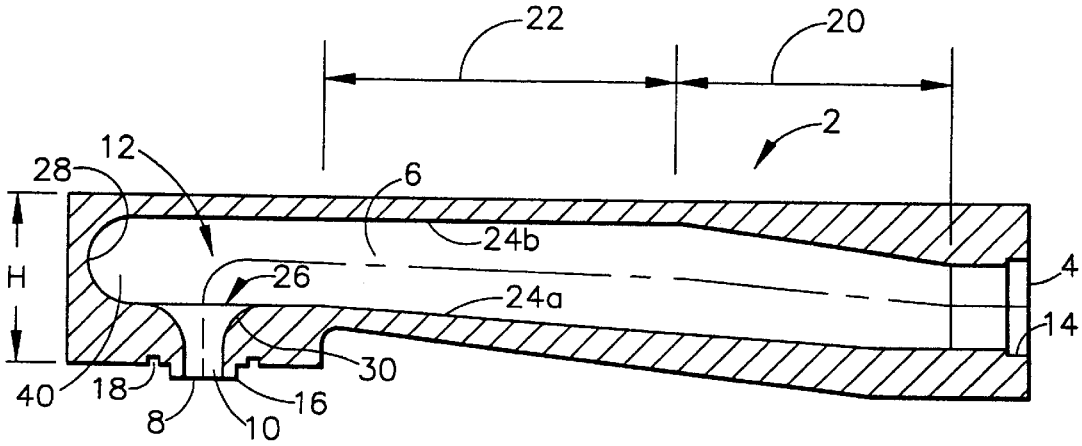
FIG. 2 is a cross-sectional view of the entrained particle flow turning device taken along line 2—2 of FIG. 1.

Referring now to the drawings in detail, wherein like numerals indicate the same elements throughout the views, a preferred embodiment of the present invention has been illustrated. FIG. 1 shows a bottom plan view of turning base 2, made of aluminum or other suitable material. As best seen in FIG. 2, which is a cross-sectional view of turning base 2 taken along line 2—2 of FIG. 1, turning base 2 includes inlet 4, first internal passageway 6 which extends in a downstream direction from inlet 4, outlet 8, and second internal passageway 10 which extends in an upstream direction from outlet 8. Second internal passageway 10 is in fluid communication with first internal passageway 6 at turn 12. Although turn 12 is shown as a 90° angle, as will be discussed below, the teachings of the present invention are applicable to other angles, not only abrupt turn angles, but even less than abrupt turns. Additionally, utilizing the teachings of the present invention, the angle of turn 12 could be greater, turning the flow of entrained particles through more than an angle of 90°.

Turning base 2 is configured to be detachably connected to a delivery hose adjacent inlet 4 in any manner as is known in the art. At inlet 4, first internal passageway 6 includes step 14 which is configured to receive an end of a delivery hose (not shown). As will be understood, other configurations may be used which are suitable for the particular connection utilized.

Turning base 2 is also configured to have a blast nozzle (not shown) connected to it adjacent outlet 8. Turning base 2 includes raised boss 16 and annular groove 18 for attachment to a nozzle. Any blast nozzle used will be adapted for the particular type of particle and operating conditions of the system. For example, it is common for $CO_2$ blast systems to utilize a converging diverging supersonic nozzle to produce supersonic fluid flow at the exit of the nozzle.

Figure 3:
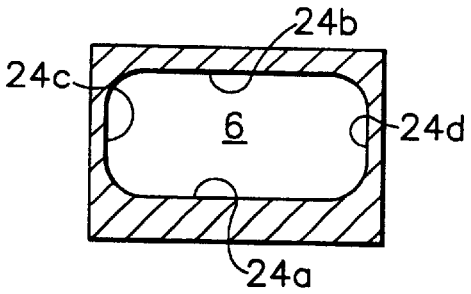
FIG. 3 is a cross-sectional view taken along line 3—3 of FIG. 1 showing like cross-sectional area profile of an internal passageway.

As can be seen in FIG. 2, first internal passageway includes an offset between the center of inlet 4 and the center of first internal passageway 6 immediately upstream of turn 12. This offset allows base height H to be reduced such that turning base 2 and associated blast nozzle (not shown) can fit into smaller spaces then would otherwise be possible without an offset. First internal flow passageway includes diverging portion 20 and converging portion 22 whose purposes will be described below. Referring also to FIG. 3, the cross-sectional profile of first internal passageway 6 is illustrated as being generally rectangular with rounded corners. First internal passageway 6 is defined by a pair of spaced apart, generally parallel in cross-section), generally flat sidewalls 24*a* and 24*b*, and by a pair of spaced apart, generally parallel (in cross-section), generally flat sidewalls 24*c*, 24*d*. In the embodiment illustrated in FIG. 2, inlet 4 is generally a circle. In order to provide an aerodynamic configuration, the radii of the four arcuate corners of the cross-sectional profile illustrated in FIG. 3 are the same as the radius of circular inlet 4.

For reasons which will be discussed below, the cross-sectional area of first internal passageway 6 is increased in diverging portion 20 by sidewall 24*b* being inclined outwardly away from sidewall 24*a*, and sidewalls 24*c* and 24*d* being inclined outwardly, as shown in FIG. 2. Within converging portion 22, sidewalls 24*c* and 24*d* remain parallel to each other while sidewall 24*a* is inclined inwardly towards sidewall 24*b*. Too much inclination in any of the sidewalls in diverging portion 20 or converging portion 22 can cause problems with particle movement.

At the downstream end of converging portion 22, the cross-sectional area profile of first internal passageway 6 is generally an obround shape with the radii of both arcuate sides being equal to the radius of circular inlet 4. This design accommodates the desired minimization of base height H by utilization of the offset. However, it will be appreciated that different inlet shapes and cross-sectional area profiles may be used to match the particular operating parameters and operating envelope. For example, the cross-sectional area profile of first internal passageway 6 could be circular, elliptical, rectangular, or a wide variety of other shapes. It is noted, that a rectangular cross-sectional profile is not particularly desirable as vortical flow may form in the corners resulting in agglomeration of particles which would eventually result in periodical dislodgment producing a pulse in the fluid flow.

As can be seen in FIG. 2, second internal passageway 10 communicates with first internal passageway 6 through opening 26 formed in sidewall 24*a*. First internal passageway 8 is also defined by end wall 28 which extends in a downstream direction beyond opening 26. As will be described below, opening 26 may be formed partially in sidewall 24*a* and end wall 28. As can be seen in FIG. 1, end wall 28 is generally circular, centered approximately about the center of outlet 8. As can be seen in FIG. 2, end wall 28 has a generally circular cross-sectional profile, and has a radius approximately equal to the radius of circular inlet 4.

Second internal passageway 10 includes entrance 30 which, as shown in profile in FIG. 2, is a bellmouth entrance, having a generally toroidal shape about second internal passageway 10. Alternatively, entrance 30 may have other profiles, such as elliptical or even square, although a very sharp corner is undesirable as it tends to separate the flow, promote vortical flow thereby creating agglomeration of $CO_2$ particles. Additionally, such vortical flow lowers the effective flow area, concentrating particles at the center of second internal passageway 10, promoting destruction of the particles. The shape of entrance 30, in combination with the configuration of base 2, is based on well-known principles of fluid dynamics, selected to match the operating conditions and parameters.

As shown in FIG. 1, opening 26 is preferably centered in sidewall 24*a* relative to sidewalls 24*c* and 24*d*. Thus being centered promotes uniform flow as it is equidistant from both sidewalls 24*c* and 24*d*. However, opening 26, and concomitantly second internal passageway 10, could be offset. Furthermore, the cross-sectional profile of second internal passageway 10 could be other than circular, such as elliptical or obround or even rectangular. As mentioned above, sharp corners as would be present in a rectangular cross-sectional profile are undesirable as they tend to produce vortical flow thereby reducing the effective cross-sectional flow area available for the entrained particle flow.

The total cross-sectional area of first internal passageway 6 as well as second internal passageway 10 is based on the desired operating parameters of the system, designed to match ergonomic requirements and practicality, while maintaining flow efficiency and maximizing the desired velocity at the blast nozzle (not shown).

Figure 4:
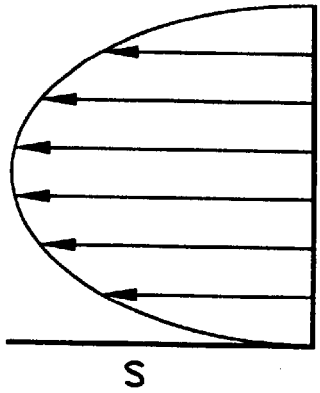
FIG. 4 is a velocity profile of an entrained particle fluid flow at the inlet of the entrained particle flow turning device.

The general operation of base 2 when used intermediate a delivery hose (not shown) and a blast nozzle (not shown) will now be described with specific reference to $CO_2$ particles. It will be understood that the functioning of turning base 2 is principally the same with other sublimable particles or harder particles such as sand or plastic beads. A fluid flow of entrained $CO_2$ particles enters first internal passageway 6 through inlet 4, with the $CO_2$ particles having a speed of approximately 60 feet per second or more. FIG. 4 illustrates a typical velocity profile for such entrained ($CO_2$ particle fluid flow at inlet 4. In order to reduce the kinetic energy of the entrained $CO_2$ particles to a level within an abrupt turn band, it is necessary to decrease the speed of the $CO_2$ particles in turning base 2. It is noted that the speed of the entrained $CO_2$ particles could be decreased upstream of turning base 2 prior to the flow entering inlet 4, however, care must be taken to avoid dropping the kinetic energy of the particles below the unsteady particle fluid flow energy level. For this reason, it is preferable that the drop in kinetic energy occur within turning base 2.

Figure 5:
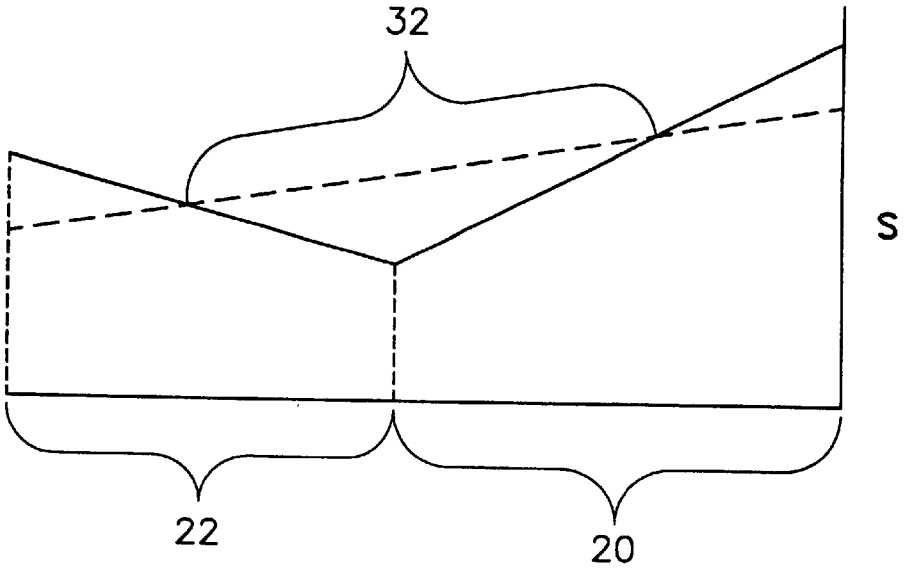
FIG. 5 is a graphical representation of the fluid speed and the entrained particle from the inlet of the entrained particle flow turning device particles to the end of the converging section.

Diverging portion 20 and converging portion 22 slow the entrained particles to a speed of about 30 feet per second by the end of converging portion 22. As is well known with respect to entrained particle flow, and in particular entrained $CO_2$ particle flow, the speed of the transport fluid is greater than the speed of the entrain particles. Referring now to FIG. 5, there is shown a graph comparing the speed of the transport fluid with the speed of the entrained particles. The solid line indicates the decrease and increase of the transport fluid flow in diverging portion 20 and converging portion 22, respectively. Correspondingly, as represented by the dashed line, the speed of the entrained $CO_2$ particles decreases, between the beginning of diverging portion 20 and the end of converging portion 22, with the speed of the entrained $CO_2$ particles being greater than the speed of the transport fluid over a range 32. This represents the lag that occurs between the speed of the entrained particles and the speed of the transport fluid when the speed of the transport fluid is changed. Although FIG. 5 shows the speed changes as being linear, the speed changes are not necessarily linear.

Dropping the speed of the transport fluid below that of the entrained particles provides for a faster deceleration of the entrained particles. By dropping the speed of the transport fluid below the speed of the entrained particles, a greater speed reduction can be effected within a given length. The speed of the transport fluid at the end of converging portion 22 preferably overruns the entrained particle by the amount necessary to produce the desired particle speed. The diverging converging sections also function to create a thinner boundary layer at the lower (as shown in FIG. 2) sidewall 24*a*.

Figure 6:
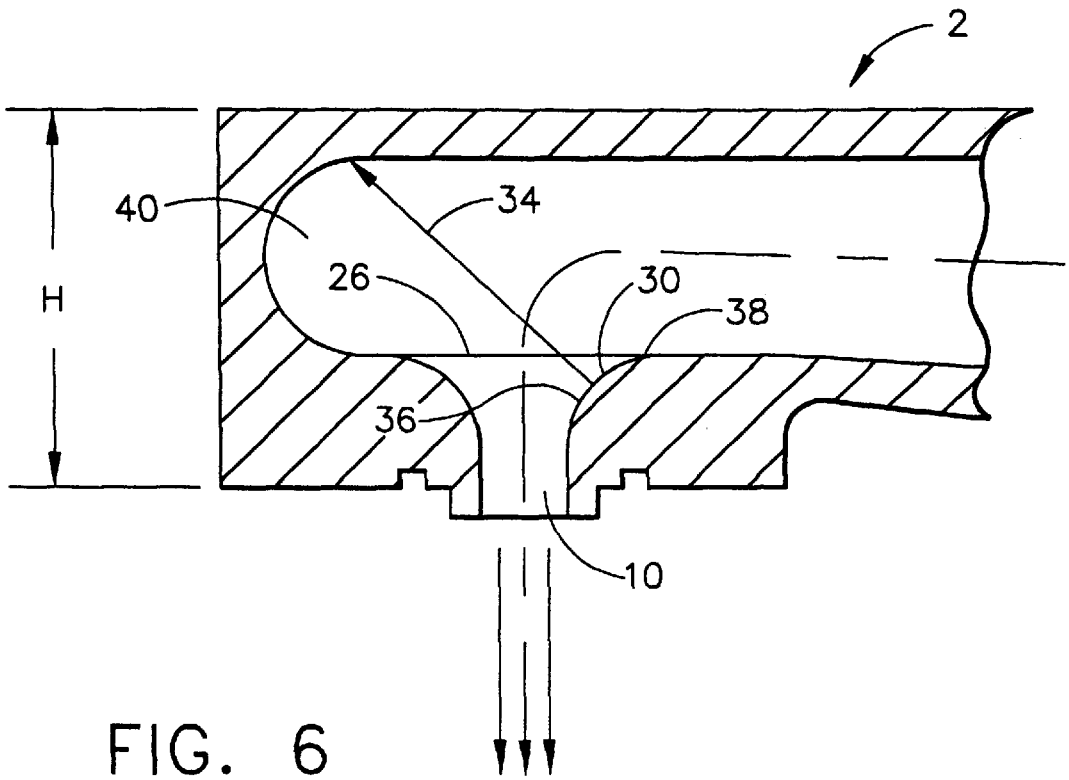
FIG. 6 is an enlarged, fragmentary cross-sectional view of the turn of the entrained particle flow turning device shown in FIG. 1.
Figure 7:
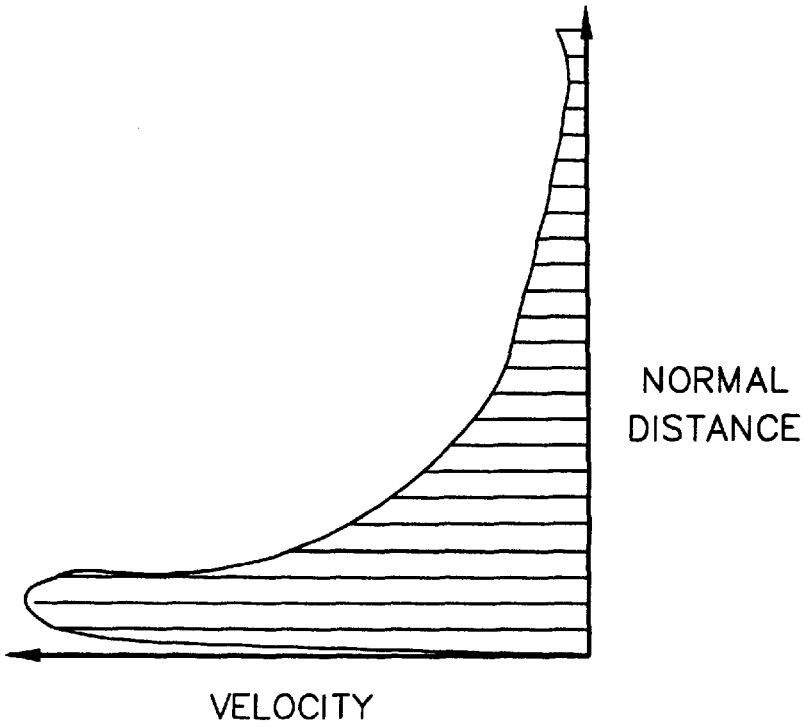
FIG. 7 is a velocity profile taken normal to the upstream wall at the location indicated in FIG. 6.

Referring now to FIG. 6, there is shown an enlarged, fragmentary cross-sectional view of first internal passageway 6, turn 12 and second internal passageway 10. As the flow progresses from inlet 4, having the velocity profile as depicted in FIG. 4, to turn 12, the velocity profile becomes more dominant adjacent sidewall 24*a* and eventually becomes as shown in FIG. 7 through turn 12. FIG. 7 represents the velocity profile taken along radial line 34 normal to entrance 30 as shown in FIG. 6. As can be seen in FIG. 7, the velocity of the flow is greatest closest to the upstream wall 36 of second internal passageway 10 which extends from leading edge 38 of opening 26. The velocity profile shown in FIG. 7 is typical of the velocity profile throughout turn 12. The greater velocity moves more mass, thus causing adjacent streamlines to be closer together. Although particles will be drawn towards the center of first internal passageway 6 due to the high velocity profile adjacent upstream wall 36, particles which remain about the periphery of first internal passageway 6 will be entrained to the sides and down stream portions of the second internal passageway.

The entrained $CO_2$ particle velocities remain relatively low as the particle flow approaches opening 26. However, as the entrained $CO_2$ particles travel adjacent and past leading edge 38, the strong velocity gradient shown in FIG. 7 is encountered, which pulls the particles in a direction which is directly normal to the general direction of flow upstream in first internal passageway 6, turning entrained particles within the high velocity portion of the velocity profile through turn 12. This strong velocity profile is the result of the internal configuration of the passageways in turning base 2. A significant feature of this internal configuration is diffusion pocket 40, which functions to slow the speed of at least a portion of the flow of the entrained particles adjacent turn 12. As can be seen, diffusion pocket 40 is defined at least in part by end wall 28 and extends downstream of opening 26 and outlet 10, and is generally aligned with the upper portions of first internal passageway 6. As entrained particles approach turn 12, the configuration of diffusion pocket 40 decelerates the transport fluid flow in the area distal to upstream wall 36 of opening 30. Diffusion pocket 40 helps produce the velocity profile shown in FIG. 7 having the high velocity adjacent upstream wall 36, thereby tending to turn the entrained particle flow by a change of fluid direction, not by forced geometry change of direction. Diffusion pocket 40 keeps the area open enough so there is not pull on the entrained particles except at upstream wall 36 and lower sidewall 24*a*.

Diffusion pocket 40 prevents significant particle-to-particle contacts or impacts and significant particle-to-wall contacts or impacts as the entrained particles are slowed to a speed such that they are pulled by the fluid flow through opening 26 without impacting end wall 28. Diffusion pocket 40 also functions to maintain smooth, non-turbulent flow such that inter-particle contacts are minimized. By minimizing the particle-to-particle and particle-to-wall contacts, particle integrity, mass in size, is preserved.

As should be readily apparent, the avoidance of significant particle-to-wall impacts within wall 28 avoids erosion of end wall 28. Thus, when turning base 2 is designed to be used with more durable particles such as sand or plastic beads, abrupt turns can be achieved without significant erosion of the component which effects the turn, in this case of end wall 28. When operated within the design parameters, particles will approximately follow the fluid streamlines and thereby avoid inter-particle collisions.

Figure 8:
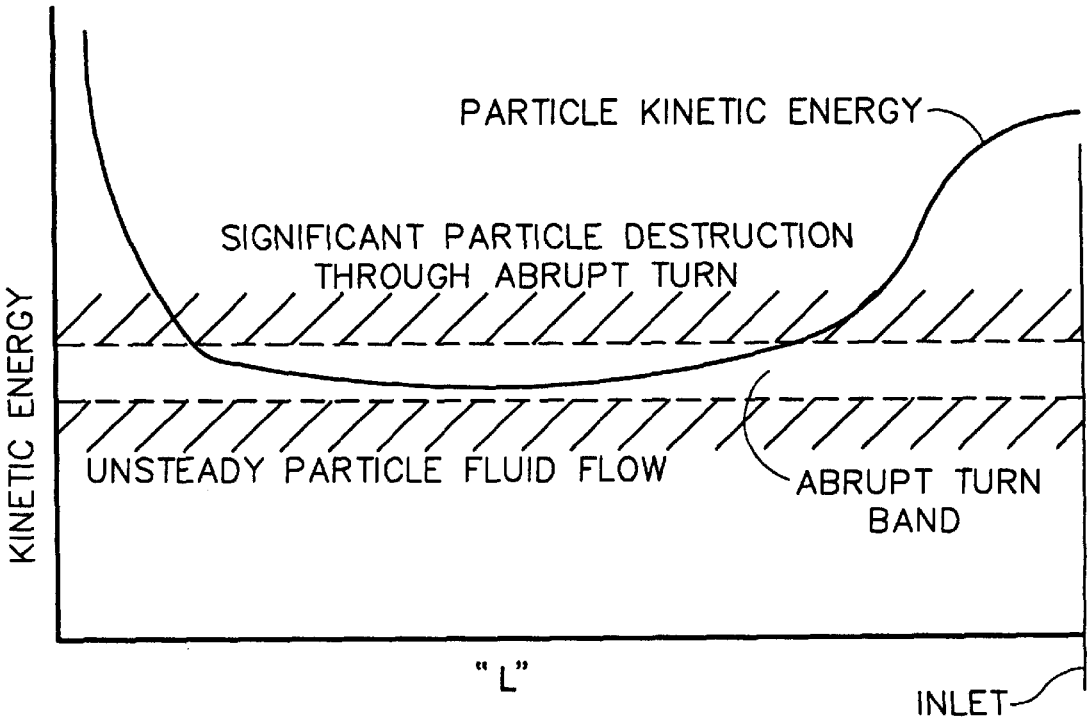
FIG. 8 is a graph illustrating the particle kinetic energy of particles flowing through the entrained particle turning device shown of FIG. 1.

Turning now to FIG. 8, there is shown a graphical representation of the particle kinetic energy as particles flow through turning base 2 from inlet 4 (right side of graph). As can be seen, the particle kinetic energy is decreased to the abrupt turn band within turning base 2 prior to the abrupt turn.

As can be seen, the kinetic energy of the $CO_2$ particles is not allowed to drop below the unsteady particle fluid flow kinetic energy level, thereby avoiding the deleterious problems with agglomeration of particles. Similarly, the particle kinetic energy is maintained below the maximum kinetic energy for avoiding significant particle destruction through an abrupt turn. The range of the abrupt turn band depends on the specific entrained particles as well as the angle of the turn. This band can be determined experimentally. For example, in the preferred embodiment, these levels were determined to be 15 feet per second to 25 feet per second for a 90° turn. As the degree of turn increases, the maximum acceptable kinetic energy for avoiding significant particle destruction decreases. Thus for a 45° turn, under the same operating parameters and identical particles, the upper limit of the abrupt turn band will be greater than that allowable for a 90° turn. Similarly, plastic beads will have a higher maximum permissible kinetic energy than $CO_2$ particles. While particle size and mass degradation is not a significant concern with more durable particles, erosion of the internal flow path is. As can be seen from the description above, diffusion pocket 40 prevents significant particle-to-wall contacts, thereby preserving the internal passageway. As will be appreciated, the teachings of the present invention may be used with such durable particles to avoid significant wear of internal passageways.

Figure 9:
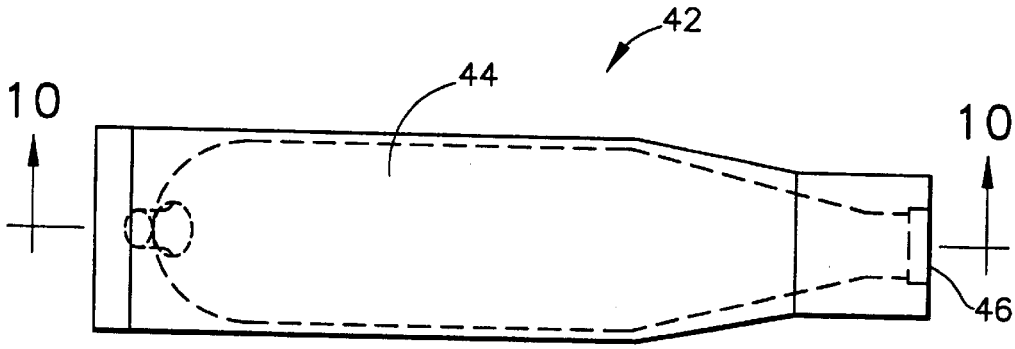
FIG. 9 is a top plan view of an alternate embodiment of an entrained particle flow turning device having a turn angle of about 45°.
Figure 10:
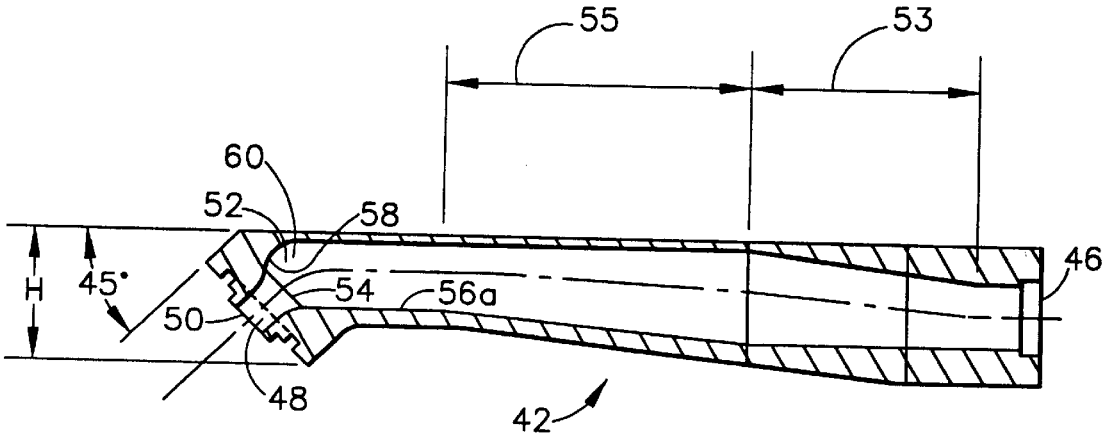
FIG. 10 is a cross-sectional view taken along line 10—10 of FIG. 9.

Referring now to FIGS. 9 and 10, there is shown an alternate embodiment of a turning base, in which the angle of the turn is 45°. Although a 45° turn is not necessarily considered an abrupt turn, the principles of the present invention may be used with a wide range of turn angles in order to improve performance and reduce erosion of the internal passageways. As shown in FIGS. 9 and 10, turning base 42 includes first internal passageway 44 which extends downstream from inlet 46, and second internal passageway 48 which extends upstream from outlet 50. Second internal passageway 50 is in fluid communication with first internal passageway 46 at turn 52. First internal passageway 46 includes diverging portion 53 and converging portion 55.

Similar to the embodiment described above, opening 54 is shown formed partially in sidewall 56*a* and partially in end wall 58. Diffusion pocket 60 is shown adjacent turn 52, and is noticeably smaller than diffusion pocket 40 for a 90°. Since the flow is turned through less of an angle, turning base 42 does not require as large a diffusion pocket. Similarly, if the angle of turn were greater than 90°, a larger diffusion pocket would be necessary, which could be accomplished, for example, by raising the height of the opposing wall.

Alternatively, opening 54 could be formed completely within either end wall 58 or sidewall 56*a* with the appropriate modifications. For example, while maintaining the 45° turn angle, second internal passageway 48 and concomitantly opening 54 could be moved upstream of end wall 58 being formed only in sidewall 56*a*. Such a construction would be accompanied by an increase in the size of diffusion pocket 60. The overall performance of a 45° turn constructed in accordance with the principles of the present invention may be enhanced with a larger diffusion pocket.

In summary, numerous benefits have been described which result from employing the concept of the invention. Abrupt turns of entrained particle fluid flow may be made without significant reduction in individual particle size and mass or erosion of the internal passageway. The present invention may be used with non-durable particles, such as $CO_2$, to avoid damage to the particles, as well as with durable particles, such as sand or beads, to avoid damage to the turning structure. The use of the present invention allows particle blasting systems to access smaller spaces with superior ergonomics then prior art particle blast systems did.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall;

a second internal passageway extending in an upstream direction from said outlet, said second internal passageway being defined by at least one second sidewall;

said second internal passageway being in fluid communication with said first internal passageway at a turn through an opening formed in at least on of said end wall and said at least one first sidewall, said second internal passageway being disposed at an angle to said first internal passageway, said second internal passageway including a bellmouth entrance adjacent said opening;

means disposed adjacent said turn for preventing significant particle-to-particle impacts and particle to wall impacts as the entrained particle flow flows from said first internal passageway to said second internal passageway, said means comprising a diffusion pocket disposed adjacent said turn whereby the direction of flow of said entrained particle flow is turned in said turn without significant reduction in size and mass of said entrained particles and without significant erosion of said entrained flow turning device adjacent said turn.

2. The entrained particle flow turning device of claim 1, wherein said means comprise means for slowing the speed of at least a portion of the flow of entrained particles adjacent said turn.

3. The entrained particle flow turning device of claim 1, wherein said diffusion pocket is disposed downstream from said turn and is generally aligned with said first internal passageway.

4. The entrained particle flow turning device of claim 3, wherein said diffusion pocket comprises an extension of said first internal flow passageway beyond said turn.

5. The entrained particle flow turning device of claim 1, wherein said entrance has a toroidal profile.

6. The entrained particle flow turning device of claim 1, wherein said entrance has an elliptical profile.

7. The entrained particle flow turning device of claim 1, wherein said entrance is includes an upstream portion, and wherein said entrance is configured to produce a non-symmetrical fluid velocity distribution normal to said fluid flow wherein the magnitude of the velocity of streamlines of said fluid flow are greatest adjacent said upstream portion of said entrance whereby slower streamlines of said fluid flow are turned by being drawn into said second flow passageway through said entrance.

8. The entrained particle flow turning device of claim 1, wherein said entrance is configured not to produce separated flow adjacent said entrance.

9. The entrained particle flow turning device of claim 1, wherein said end wall extends in said downstream direction beyond said opening.

10. The entrained particle flow turning device of claim 1, wherein said first internal passageway is configured to slow said fluid flow so as to slow the entrained particles.

11. The entrained particle flow turning device of claim 1, wherein said first internal passageway is configured to decelerate then accelerate said fluid flow.

12. The entrained particle flow turning device of claim 11, wherein said first internal passageway includes a diverging portion.

13. The entrained particle flow turning device of claim 11, wherein said first internal passageway includes a converging portion.

14. The entrained particle flow turning device of claim 1, wherein said first internal passageway includes an offset between said inlet and said turn.

15. The entrained particle flow turning device of claim 1, wherein said end well is curved.

16. The entrained particle flow turning device of claim 1, wherein said first internal passageway has a normal cross-sectional shape at at least one location which includes a pair of arcuate sidewalls separated by a pair of spaced apart, substantially flat sidewalls.

17. The entrained particle flow turning device of claim 16, wherein said inlet has a normal cross-sectional shape which is generally a circle, and said obround nomrmal cross-sectional shape includes arcuate ends having respective radii approximately equal to the radius of said circle.

18. The entrained particle flow turning device of claim 16, wherein at least a portion of said opening is formed in one of said flat sidewalls.

19. The entrained particle flow turning device of claim 16, wherein said opening is formed approximately equidistant from said arcuate sidewalls.

20. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall;

a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall;

said first internal passageway including a diverging portion located between said inlet and said opening, said first internal passageway being configured to produce, when said entrained particle flow flows therethrough at predetermined operating conditions, a thin boundary layer along a portion of said at least one sidewall of said first internal passageway adjacent said opening.

21. The entrained particle flow turning device of claim 20, wherein said first internal passageway includes a converging portion located between said diverging portion and said opening.

22. The entrained particle flow turning device of claim 20, wherein said first internal passageway includes a converging portion located between said inlet and said opening.

23. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall;

a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall;

said second internal passageway including an entrance adjacent said opening, said entrance being a bellmouth entrance.

24. The entrained particle flow turning device of claim 23, wherein said first internal passageway is configured to slow said fluid flow so as to slow the entrained particles.

25. The entrained particle flow turning device of claim 24, wherein said first internal passageway is configured to decelerate then accelerate said fluid flow.

26. The entrained particle flow turning device of claim 23, wherein said first internal passageway has a normal cross-sectional area which changes in the downstream direction.

27. The entrained particle flow turning device of claim 24, wherein said first internal passageway has a normal cross-sectional area which increases then decreases in the downstream direction.

28. The entrained particle flow turning device of claim 23, wherein said first internal passageway includes an offset between said inlet and said opening.

29. The entrained particle flow turning device of claim 23, wherein said entrance has a toroidal profile.

30. The entrained particle flow turning device of claim 23, wherein said entrance has an elliptical profile.

31. The entrained particle flow turning device of claim 23, wherein said entrance is configured not to produce separated flow adjacent said entrance.

32. The entrained particle flow turning device of claim 23, wherein said entrance includes an upstream portion, and wherein said entrance is configured to produce a non-symmetrical fluid velocity distribution normal to said fluid flow wherein the magnitude of the velocity of streamlines of said fluid flow are greatest adjacent said upstream portion of said entrance whereby slower streamlines of said fluid flow are turned by being drawn into said second flow passageway through said entrance.

33. The entrained particle flow turning device of claim 23, wherein said end wall is curved.

34. The entrained particle flow turning device of claim 33, wherein said inlet has a normal cross-sectional shape which is generally a circle, and said pair of arcuate sidewalls have respective radii approximately equal to the radius of said circle.

35. The entrained particle flow turning device of claim 33, wherein at least a portion of said opening is formed in one of said flat sidewalls.

36. The entrained particle flow turning device of claim 33, wherein said opening is formed approximately equidistant from said arcuate sidewalls.

37. The entrained particle flow turning device of claim 23, wherein at least a portion of said first internal passageway has a normal cross-sectional shape which includes a pair of arcuate sidewalls separated by a pair of spaced apart, substantially flat sidewalls.

38. The entrained particle flow turning device of claim 23, wherein a portion of said first internal flow passageway extends downstream of said opening.

39. A method of changing the direction of a fluid flow containing entrained particles, said method comprising the steps of:

(a) directing said fluid flow through a first internal passageway;

(b) turning said fluid flow into a second internal passageway at a turn, said first internal passageway being in fluid communication with said second internal passageway;

(c) slowing the speed of a portion of said particles at said turn such that significant particle-to-particle contacts and particle-to-wall contacts are prevented whereby the direction of flow of said entrained particle flow is turned in said turn without significant destruction to said entrained particles and said first and second internal passageways and said turn.

40. The method of claim 39, wherein the speed of said portion of said particles is slowed in step (c) to be within an abrupt turn band.

41. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall, said first internal passageway having a normal cross-sectional area which changes in the downstream direction; and a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall.

42. The entrained particle flow turning device of claim 41, wherein said first internal passageway is configured to slow said fluid flow so as to slow the entrained particles.

43. The entrained particle flow turning device of claim 41, wherein said first internal passageway is configured to decelerate then accelerate said fluid flow.

44. The entrained particle flow turning device of claim 41, wherein said first internal passageway has a normal cross-sectional area which increases then decreases in the downstream direction.

45. The entrained particle flow turning device of claim 41, wherein said first internal passageway includes an offset between said inlet and said opening.

46. The entrained particle flow turning device of claim 41, wherein said second internal passageway includes an entrance adjacent said opening, said entrance being arcuate.

47. The entrained particle flow turning device of claim 41, wherein said second internal passageway includes an entrance adjacent said opening, said entrance having a toroidal profile.

48. The entrained particle flow turning device of claim 41, wherein said entrance has an elliptical profile.

49. The entrained particle flow turning device of claim 41, wherein said entrance has a rectangular profile.

50. The entrained particle flow turning device of claim 41, wherein said entrance includes an upstream portion, and wherein said entrance is configured to produce a non-symmetrical fluid velocity distribution normal to said fluid flow wherein the magnitude of the velocity of streamlines of said fluid flow are greatest adjacent said upstream portion of said entrance whereby slower streamlines of said fluid flow are turned by being drawn into said second flow passageway through said entrance.

51. The entrained particle flow turning device of claim 41, wherein said entrance is configured not to produce separated flow adjacent said entrance.

52. The entrained particle flow turning device of claim 41, wherein said first passageway, said entrance and said second passageway are configured not to produce vortical flow adjacent said entrance.

53. The entrained particle flow turning device of claim 41, wherein at least a portion of said first internal passageway has a normal cross-sectional shape which includes a pair of arcuate sidewalls separated by a pair of spaced apart, substantially flat sidewalls.

54. The entrained particle flow turning device of claim 53, wherein said inlet has a normal cross-sectional shape which is generally a circle, and said pair of arcuate sidewalls have respective radii approximately equal to the radius of said circle.

55. The entrained particle flow turning device of claim 54, wherein at least a portion of said opening is formed in one of said flat sidewalls.

56. The entrained particle flow turning device of claim 54, wherein said opening is formed approximately equidistant from said arcuate sidewalls.

57. The entrained particle flow turning device of claim 41, wherein a portion of said first internal flow passageway extends downstream of said opening.

58. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall, said first internal passageway being configured to slow said fluid flow so as to slow the entrained particles and to decelerate then accelerate said fluid flow; and a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall.

59. The entrained particle flow turning device of claim 58, wherein said first internal passageway has a normal cross-sectional area which increases then decreases in the downstream direction.

60. The entrained particle flow turning device of claim 58, wherein said first internal passageway includes an offset between said inlet and said opening.

61. The entrained particle flow turning device of claim 58, wherein said second internal passageway includes an entrance adjacent said opening, said entrance being arcuate.

62. The entrained particle flow turning device of claim 58, wherein said second internal passageway includes an entrance adjacent said opening, said entrance having a toroidal profile.

63. The entrained particle flow turning device of claim 58, wherein said entrance has an elliptical profile.

64. The entrained particle flow turning device of claim 58, wherein said entrance has a rectangular profile.

65. The entrained particle flow turning device of claim 58, wherein said entrance includes an upstream portion, and wherein said entrance is configured to produce a non-symmetrical fluid velocity distribution normal to said fluid flow wherein the magnitude of the velocity of streamlines of said fluid flow are greatest adjacent said upstream portion of said entrance whereby slower streamlines of said fluid flow are turned by being drawn into said second flow passageway through said entrance.

66. The entrained particle flow turning device of claim 58, wherein said entrance is configured not to produce separated flow adjacent said entrance.

67. The entrained particle flow turning device of claim 58, wherein said first passageway, said entrance and said second passageway are configured not to produce vortical flow adjacent said entrance.

68. The entrained particle flow turning device of claim 58, wherein at least a portion of said first internal passageway has a normal cross-sectional shape which includes a pair of arcuate sidewalls separated by a pair of spaced apart, substantially flat sidewalls.

69. The entrained particle flow turning device of claim 68, wherein said inlet has a normal cross-sectional shape which is generally a circle, and said pair of arcuate sidewalls have respective radii approximately equal to the radius of said circle.

70. The entrained particle flow turning device of claim 68, wherein at least a portion of said opening is formed in one of said flat sidewalls.

71. The entrained particle flow turning device of claim 68, wherein said opening is formed approximately equidistant from said arcuate sidewalls.

72. The entrained particle flow turning device of claim 58, wherein a portion of said first internal flow passageway extends downstream of said opening.

73. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall, said first internal passageway having a normal cross-sectional area which increases then decreases in the downstream direction; and a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall.

74. The entrained particle flow turning device of claim 73, wherein said first internal passageway is configured to slow said entrained particles prior to said entrained particle reaching said opening.

75. The entrained particle flow turning device of claim 74, wherein said first internal passageway includes an offset between said inlet and said opening.

76. The entrained particle flow turning device of claim 74, wherein said second internal passageway includes an entrance adjacent said opening, said entrance being arcuate.

77. The entrained particle flow turning device of claim 74, wherein said second internal passageway includes an entrance adjacent said opening, said entrance having a toroidal profile.

78. The entrained particle flow turning device of claim 74, wherein said entrance has an elliptical profile.

79. The entrained particle flow turning device of claim 74, wherein said entrance has a rectangular profile.

80. The entrained particle flow turning device of claim 74, wherein said entrance includes an upstream portion, and wherein said entrance is configured to produce a non-symmetrical fluid velocity distribution normal to said fluid flow wherein the magnitude of the velocity of streamlines of said fluid flow are greatest adjacent said upstream portion of said entrance whereby slower streamlines of said fluid flow are turned by being drawn into said second flow passageway through said entrance.

81. The entrained particle flow turning device of claim 74, wherein said entrance is configured not to produce separated flow adjacent said entrance.

82. The entrained particle flow turning device of claim 74, wherein said first passageway, said entrance and said second passageway are configured not to produce vortical flow adjacent said entrance.

83. The entrained particle flow turning device of claim 74, wherein at least a portion of said first internal passageway has a normal cross-sectional shape which includes a pair of arcuate sidewalls separated by a pair of spaced apart, substantially flat sidewalls.

84. The entrained particle flow turning device of claim 83, wherein said inlet has a normal cross-sectional shape which is generally a circle, and said pair of arcuate sidewalls have respective radii approximately equal to the radius of said circle.

85. The entrained particle flow turning device of claim 83, wherein at least a portion of said opening is formed one of said flat sidewalls.

86. The entrained particle flow turning device of claim 83, wherein said opening is formed approximately equidistant from said arcuate sidewalls.

87. The entrained particle flow turning device of claim 74, wherein a portion of said first internal flow passageway extends downstream of said opening.

88. An entrained particle flow turning device to change the direction of a fluid flow containing entrained particles, said entrained particle flow turning device comprising:

an inlet;

an outlet;

a first internal passageway extending in a downstream direction from said inlets at least a portion of said first internal passageway being defined by at least one first generally flat sidewall and an end wall; and a second internal passageway extending in an upstream direction from said outlet, said second internal passageway being defined by at least one second sidewall;

said second internal passageway communicating at an angle with said first internal passageway through an opening, at least a portion of said opening being formed in said at least one first generally flat side wall.

89. The entrained particle flow turning device of claim 88, wherein said first internal passageway is configured to slow said fluid flow so as to slow the entrained particles.

90. The entrained particle flow turning device of claim 88, wherein said first internal passageway includes an offset between said inlet and said opening.

91. The entrained particle flow turning device of claim 88, wherein said second internal passageway includes an entrance adjacent said opening, said entrance being arcuate.

92. The entrained particle flow turning device of claim 88, wherein said second internal passageway includes an entrance adjacent said opening, said entrance having a toroidal profile.

93. The entrained particle flow turning device of claim 88, wherein said entrance has an elliptical profile.

94. The entrained particle flow turning device of claim 88, wherein said entrance has a rectangular profile.

95. The entrained particle flow turning device of claim 88, wherein said entrance includes an upstream portion, and wherein said entrance is configured to produce a non-symmetrical fluid velocity distribution normal to said fluid flow wherein the magnitude of the velocity of streamlines of said fluid flow are greatest adjacent said upstream portion of said entrance whereby slower streamlines of said fluid flow are turned by being drawn into said second flow passageway through said entrance.

96. The entrained particle flow turning device of claim 88, wherein said entrance is configured not to produce separated flow adjacent said entrance.

97. The entrained particle flow turning device of claim 88, wherein said first passageway, said entrance and said second passageway are configured not to produce vortical flow adjacent said entrance.

98. The entrained particle flow turning device of claim 88, wherein said at least a portion of said first internal passageway which is defined by said first generally flat sidewall has a normal cross-sectional shape which includes a pair of arcuate sidewalls separated by said at least one first generally flat sidewall and a second generally flat sidewall spaced apart from said first generally flat sidewall.

99. The entrained particle flow turning device of claim 98, wherein said inlet has a normal cross-sectional shape which is generally a circle, and said pair of arcuate sidewalls have respective radii approximately equal to the radius of said circle.

100. The entrained particle flow turning device of claim 98, wherein at least a portion of said opening is formed in said end wall.

101. The entrained particle flow turning device of claim 98, wherein said opening is formed approximately equidistant from said arcuate sidewalls.

102. The entrained particle flow turning device of claim 88, wherein a portion of said first internal flow passageway extends downstream of said opening.

103. The entrained particle flow turning device of claim 88, wherein a portion of said first generally flat sidewall extends downstream of said opening.

104. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall, at least a portion of said first internal passageway having a normal cross-sectional shape which includes a pair of arcuate sidewalls separated by a pair of spaced apart, generally flat sidewalls; and a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall;

wherein at least a portion of one of said pair of spaced apart, generally flat sidewalls comprises at least a portion of said at least one first sidewall.

105. The entrained particle flow turning device of claim 104, wherein said first internal passageway is configured to slow said fluid flow so as to slow the entrained particles.

106. The entrained particle flow turning device of claim 104, wherein said first internal passageway includes an offset between said inlet and said opening.

107. The entrained particle flow turning device of claim 104, wherein said second internal passageway includes an entrance adjacent said opening, said entrance being arcuate.

108. The entrained particle flow turning device of claim 104, wherein said second internal passageway includes an entrance adjacent said opening, said entrance having a toroidal profile.

109. The entrained particle flow turning device of claim 104, wherein said entrance has an elliptical profile.

110. The entrained particle flow turning device of claim 104, wherein said entrance has a rectangular profile.

111. The entrained particle flow turning device of claim 104, wherein said entrance includes an upstream portion, and wherein said entrance is configured to produce a non-symmetrical fluid velocity distribution normal to said fluid flow wherein the magnitude of the velocity of streamlines of said fluid flow are greatest adjacent said upstream portion of said entrance whereby slower streamlines of said fluid flow are turned by being drawn into said second flow passageway through said entrance.

112. The entrained particle flow turning device of claim 104, wherein said entrance is configured not to produce separated flow adjacent said entrance.

113. The entrained particle flow turning device of claim 104, wherein said first passageway, said entrance and said second passageway are configured not to produce vortical flow adjacent said entrance.

114. The entrained particle flow turning device of claim 104, wherein said inlet has a normal cross-sectional shape which is generally a circle, and said pair of arcuate sidewalls have respective radii approximately equal to the radius of said circle.

115. The entrained particle flow turning device of claim 104, wherein said opening is formed approximately equidistant from said arcuate sidewalls.

116. The entrained particle flow turning device of claim 104, wherein a portion of said first internal flow passageway extends downstream of said opening.

117. The entrained particle flow turning device of claim 104, wherein a portion of said first generally flat sidewall extends downstream of said opening.

118. An entrained particle flow turning device to change the direction of a fluid flow containing entrained particles, said entrained particle flow turning device comprising:

an inlet;

an outlet;

a first internal passageway extending in a downstream direction from said inlet, said first internal passageway having a normal cross-sectional shape at at least one location which includes a pair of arcuate sidewalls separated by a pair of spaced apart, generally flat sidewalls;

a second internal passageway extending in an upstream direction from said outlet;

said second internal passageway being in fluid communication with said first internal passageway at a turn, said second internal passageway being disposed at an angle to said first internal passageway;

means disposed adjacent said turn for preventing significant particle-to-particle impacts and particle to wall impacts as the entrained particle flow flows from said first internal passageway to said second internal passageway whereby the direction of flow of said entrained particle flow is turned in said turn without significant reduction in size and mass of said entrained particles and without significant erosion of said entrained flow turning device adjacent said turn.

119. The entrained particle flow turning device of claim 118, wherein said means comprise a diffusion pocket disposed adjacent said turn.

120. The entrained particle flow turning device of claim 118, wherein said inlet has a normal cross-sectional shape which is generally a circle, and said arcuate ends have respective radii approximately equal to the radius of said circle.

121. The entrained particle flow turning device of claim 118, wherein at least a portion of said opening is formed in one of said flat sidewalls.

122. The entrained particle flow turning device of claim 118, wherein said opening is formed approximately equidistant from said arcuate sidewalls.

123. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall;

a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall;

said first internal passageway including a converging portion located between said inlet and said opening; said first internal passageway being configured to produce, when said entrained particle flow flows therethrough at predetermined operating conditions, a thin boundary layer along a portion of said at least one sidewall of said first internal passageway adjacent said opening.

124. The entrained particle flow turning device of claim 123, wherein said first internal passageway has a normal cross-sectional area which increases then decreases in the downstream direction.

125. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall, said first internal passageway being configured to decelerate said fluid flow so as to slow the entrained particles;

a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall.

126. The entrained particle flow turning device of claim 125 wherein said first internal passageway includes a diverging portion.

127. The entrained particle flow turning device of claim 125, wherein said first internal passageway is configured to decelerate then accelerate said fluid flow.

128. The entrained particle flow turning device of claim 125, wherein said first internal passageway includes a diverging portion and a converging portion.

129. The entrained particle flow turning device of claim 128, wherein said opening is a bellmouth opening.

130. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and an end wall;

a second internal passageway extending in an upstream direction from said outlet, said second internal passageway being defined by at least one second sidewall;

said second internal passageway communicating at an angle with said first internal passageway through an opening, at least a portion of said opening being formed in at least one of said end wall and said at least one first side wall;

said first internal passageway including a diverging-converging portion located between said inlet and said opening.

131. The entrained particle flow turning device of claim 130, wherein at least a portion of said opening is formed in said end wall and a portion of said opening is formed in said first sidewall.

132. The entrained particle flow turning device of claim 130, wherein said opening is a bellmouth opening.

133. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and terminating in a blind end;

a second internal passageway extending in an upstream direction from said outlet, said second internal passageway being defined by at least one second sidewall;

said second internal passageway communicating at an angle with said first internal passageway through an opening, said opening being formed in said at least one first side wall.

134. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and terminating in a blind end;

a second internal passageway extending in an upstream direction from said outlet, said second internal passageway being defined by at least one second sidewall;

said second internal passageway communicating at an angle with said first internal passageway through an opening, said opening being formed in said at least one first side wall, said second passageway including a bellmouth entrance adjacent said opening.

135. An entrained particle flow turning device to change the direction of a fluid flow containing entrained particles, said entrained particle flow turning device comprising:

an inlet:

an outlet;

a first internal passageway extending in a downstream direction from said inlet, said first internal passageway being defined by at least one first sidewall and terminating in a blind end;

a second internal passageway extending in an upstream direction from said outlet, said second internal passageway being defined by at least one second sidewall;

said second internal passageway communicating at an angle with said first internal passageway through an opening, said opening being formed in said at least one first side wall;

said first internal passageway including a diverging-converging portion located between said inlet and said opening.

136. An entrained particle flow turning device to change the direction of a fluid flow containing entrained particles, said entrained particle flow turning device comprising:

an inlet;

an outlet;

a first internal passageway extending in a downstream direction from said inlet, said first internal passageway being defined by at least one first sidewall and terminating in a blind end;

a second internal passageway extending in an upstream direction from said outlet, said second internal passageway being defined by at least one second sidewall;

said second internal passageway communicating at an angle with said first internal passageway through an opening, said opening being formed in said at least one first side wall;

said first internal passageway including a normal cross-sectional area immediately upstream of said opening, second internal passageway including a normal cross-sectional area downstream of said opening, said normal cross-sectional area of said second internal passageway being smaller than said normal cross-sectional area of said first internal passageway.

137. An entrained particle flow turning device to change the direction of a fluid flow containing entrained particles, said entrained particle flow for use with a converging-diverging flow passageway downstream of said entrained particle flow turning device, said entrained particle flow turning device comprising:

an inlet;

an outlet, the converging-diverging flow passageway being disposed downstream of said outlet;

a first internal passageway extending in a downstream direction from said inlet, said first internal passageway being defined by at least one first sidewall;

a second internal passageway extending in an upstream direction from said outlet, said second internal passageway being defined by at least one second sidewall;

said second internal passageway communicating at an angle with said first internal passageway through an opening, said opening being formed in said at least one first side wall;

said first internal passageway, said second internal passageway and said opening being configured to create a lower pressure in said second internal passageway such that said entrained particles are drawn into said second internal passageway from said first internal passageway.

138. An entrained particle flow turning device to change the direction of a fluid flow containing entrained particles in combination with a converging-diverging nozzle located downstream of said entrained particle flow turning device, said entrained particle flow turning device comprising:

an inlet;

an outlet, said converging-diverging nozzle being disposed downstream of said outlet;

a first internal passageway extending in a downstream direction from said inlet, said first internal passageway being defined by at least one first sidewall;

a second internal passageway extending in an upstream direction from said outlet, said second internal passageway being defined by at least one second sidewall;

said second internal passageway communicating at an angle with said first internal passageway through an opening, said opening being formed in said at least one first side wall;

said first internal passageway, said second internal passageway and said opening being configured to create a lower pressure in said second internal passageway such that said entrained particles are drawn into said second internal passageway from said first internal passageway.

139. A method of changing the direction of a fluid flow containing entrained particles, said method comprising the steps of:

(a) directing said fluid flow into a first internal passageway;

(b) decelerating then accelerating said fluid flow in said first internal passageway;

(c) turning said fluid flow into a second internal passageway at a turn, said first internal passageway being in fluid communication with said second internal passageway;

(d) slowing the speed of a portion of said particles at said turn such that significant particle-to-particle contacts and particle-to-wall contacts are prevented whereby the direction of flow of said entrained particle flow is turned in said turn without significant destruction to said entrained particles and said first and second internal passageways and said turn.

140. A method of changing the direction of a fluid flow containing entrained particles, said method comprising the steps of:

(a) directing said fluid flow into a first internal passageway;

(b) turning said fluid flow into a second internal passageway at a turn, said first internal passageway being in fluid communication with said second internal passageway, said turn including an entrance, said entrance having an upstream portion;

(c) creating a velocity profile perpendicular to said upstream portion in which the speed of the particles decrease from a maximum speed near said upstream portion to a minimum speed distal to said up stream portion.

141. The method of claim 140 wherein said entrance is configured not to produce separated flow adjacent said entrance.

142. The method of claim 140 wherein said first passageway, said entrance and said second passageway are configured not to produce vortical flow adjacent said entrance.

143. A method of changing the direction of a fluid flow containing entrained particles, said method comprising the steps of:

(a) directing said fluid flow into a first internal passageway;

(b) turning said fluid flow into a second internal passageway at a turn, said first internal passageway being in fluid communication with said second internal passageway, said turn including an entrance, said entrance having an upstream portion;

(c) creating a non-symmetrical fluid velocity distribution normal to said fluid flow wherein the velocity of streamlines of said fluid flow are greatest adjacent said upstream portion of said entrance.

144. The method of claim 143 wherein said entrance is configured not to produce separated flow adjacent said entrance.

145. The method of claim 143 wherein said first passageway, said entrance and said second passageway are configured not to produce vortical flow adjacent said entrance.

* * * * *

UNITED STATES PATENT AND TRADEMARK OFFICE

CERTIFICATE OF CORRECTION

PATENT NO. : 6,042,458
DATED : March 28, 2000
INVENTOR(S) : Tony R. Lehnig; Frederick C. Young and David R. Linger It is certified that error appears in the above-identified patent and that said Letters Patent is hereby corrected as shown below:

Column 12, claim 7,
Line 15, delete "is"

Column 12, claim 15,
Line 45, change "well" to -- wall --.

Column 12, claim 17,
Line 53, change "nomrmal" to -- normal --.

Column 13, claim 27,
Line 52, change "claim 24" to -- claim 26 --.

Column 18, claim 88,
Line 7, change "inlets" to -- inlet --.

Column 22, claim 135,
Line 39, change "inlet:" to -- inlet; --.

Column 24, claim 140,
Line 32, change "up stream" to -- upstream --

Signed and Sealed this

Second Day of April, 2002

*Attest:*

*Attesting Officer*

JAMES E. ROGAN
*Director of the United States Patent and Trademark Office*